US005752602A

United States Patent [19]

Ackermann et al.

[11] Patent Number: 5,752,602

[45] Date of Patent: May 19, 1998

[54] STACKABLE AND NESTABLE ONE PART CONTAINER

[75] Inventors: Jeffrey Robert Ackermann, Manhattan Beach, Calif.; William Patrick Apps, Alpharetta, Ga.; Glenn McCord Phillips, Manhattan Beach, Calif.

[73] Assignee: Rehrig-Pacific Company Inc., Los Angeles, Calif.

[21] Appl. No.: 600,455

[22] Filed: Feb. 13, 1996

[51] Int. Cl.[6] ..... B65D 21/04

[52] U.S. Cl. ..... 206/507; 206/505; 206/511; 206/512

[58] Field of Search ..... 206/507, 505, 206/511, 512

[56] References Cited

U.S. PATENT DOCUMENTS

| | | | |
|---|---|---|---|
| Re. 26,350 | 2/1968 | Wilson | 206/505 |
| D. 197,091 | 12/1963 | Crane | D58/4 |
| D. 197,311 | 1/1964 | Spaak et al. | D58/12.6 |
| D. 198,594 | 7/1964 | Casteliano | D58/12.6 |
| D. 248,280 | 6/1978 | Martin | D9/243 |
| D. 252,172 | 6/1979 | Carroll et al. | D3/67 |
| D. 259,400 | 6/1981 | Carroll et al. | D99/44 |
| D. 266,914 | 11/1982 | Miller | D11/155 |
| D. 274,967 | 8/1984 | Taylor | D6/510 |

(List continued on next page.)

FOREIGN PATENT DOCUMENTS

| | | | |
|---|---|---|---|
| 675843 | 12/1963 | Canada | 190/26 |
| 778627 | 2/1968 | Canada | 190/73.5 |
| 1022090 | 12/1977 | Canada | 190/34.3 |
| 2 332 920 | 7/1977 | France | 206/507 |
| 2 504 889 | 11/1982 | France | 206/507 |
| 2 547 561 | 12/1984 | France . | |
| 1 603 046 | 11/1981 | United Kingdom . | |
| 2 223 481 | 4/1990 | United Kingdom . | |
| 2 227 232 | 7/1990 | United Kingdom . | |

OTHER PUBLICATIONS

"Cooling Table Grapes," Author unknown, Undated, pp. 40, 44–48 (admitted prior art).

"II. Cooling Methods," *Postharvest Technology of Horticultural Crops*, 2d ed., Adel A. Kadner & F. Gordon Mitchell, Univ. Of Calif. Division of Agriculture & Natural Resources, Publication 3311, 1992 (best available copy).

*Primary Examiner*—Joseph M. Moy

*Attorney, Agent, or Firm*—Banner & Witcoff, Ltd.

[57] ABSTRACT

A stackable and nestable container having a bottom surface, a first pair of opposed end walls integrally joined with the bottom surface and extending upwardly away therefrom, and a second pair of opposed side walls integrally joined with the bottom surface and extending upwardly away therefrom. The first and second pairs of opposed end walls and side walls are integrally joined with each other along common end surfaces thereof to form with the bottom surface a substantially rectangular open top container. Each of the end walls and side walls includes a pair of column sections, and each of the column sections includes a recessed portion, an inner shelf and a lower column support. Each of the end walls and side walls further includes a pair of stacking sections, and each of the stacking sections includes a stacking foot and a stacking shelf. The stackable and nestable container is adapted to be nestable with a similarly shaped container when the containers are disposed in a first orientation and the stackable and nestable container is adapted to be stackable with a similarly shaped container when the containers are disposed in a second orientation.

17 Claims, 10 Drawing Sheets

U.S. PATENT DOCUMENTS

| | | | |
|---|---|---|---|
| D. 302,620 | 8/1989 | Quong | D34/40 |
| D. 328,662 | 8/1992 | Maglione | D34/40 |
| 2,064,518 | 12/1936 | Brogden | 220/97 |
| 2,695,115 | 11/1954 | Roop | 220/42 |
| 3,113,680 | 12/1963 | Frater et al. | 206/507 |
| 3,270,913 | 9/1966 | Bridenstine et al. | 220/97 |
| 3,326,410 | 6/1967 | Asenbauer | 220/97 |
| 3,331,529 | 7/1967 | Slapnik | 220/97 |
| 3,351,229 | 11/1967 | Bridenstine | 220/97 |
| 3,360,162 | 12/1967 | Miles | 220/97 |
| 3,420,402 | 1/1969 | Frater et al. | 206/507 |
| 3,447,715 | 6/1969 | Beney | 220/97 |
| 3,481,502 | 12/1969 | Slayman | 217/42 |
| 3,547,309 | 12/1970 | Pusey et al. . | |
| 3,638,827 | 2/1972 | Lau et al. | 206/507 |
| 3,682,351 | 8/1972 | De Putter | 220/97 B |
| 3,700,137 | 10/1972 | Souza | 220/97 E |
| 3,734,341 | 5/1973 | Levenhagen | 206/507 |
| 3,759,416 | 9/1973 | Constantine | 220/97 F |
| 3,773,213 | 11/1973 | Fredrick | 220/97 D |
| 4,000,817 | 1/1977 | Sanders et al. | 206/505 |
| 4,027,796 | 6/1977 | Martin | 206/507 |
| 4,093,070 | 6/1978 | Stahl | 206/507 |
| 4,105,117 | 8/1978 | Atkin et al. | 206/501 |
| 4,139,098 | 2/1979 | Mollon | 206/507 |
| 4,189,052 | 2/1980 | Carroll et al. | 206/507 |
| 4,225,046 | 9/1980 | Ettema | 206/511 |
| 4,478,344 | 10/1984 | Rehrig | 220/83 |
| 4,759,451 | 7/1988 | Apps | 211/126 |
| 4,848,580 | 7/1989 | Wise | 206/519 |
| 4,982,844 | 1/1991 | Madan et al. | 206/507 |
| 5,031,761 | 7/1991 | de Larosiere | 206/203 |
| 5,042,674 | 8/1991 | Ramsay et al. | 220/4.24 |
| 5,344,022 | 9/1994 | Stahl | 206/507 |
| 5,415,293 | 5/1995 | Ackermann et al. | 206/506 |

STACKABLE AND NESTABLE ONE PART CONTAINER

TECHNICAL FIELD

The present invention relates to a stackable and nestable open-top container and, more particularly, to a container which is specifically adapted to receive perishable food items which require circulation of a cooled air flow, such as grapes.

BACKGROUND OF THE INVENTION

Table grapes must be cooled promptly and thoroughly after harvest to maintain satisfactory quality. The grapes must be cooled immediately to (1) minimize water loss from the fruit, (2) retard the development of decay caused by fungi, and (3) reduce the rate of respiration of the fruit. Thus, immediately after harvesting, grapes are packaged in a container, crate, or a "lug" as it is referred to in the field, and shipped to a temporary storage facility so that they may be cooled to a desirable temperature.

There are three general methods of cooling grapes in the temporary storage facility. These methods include conduction, parallel flow cooling, and forced air cooling, each of which differs in the manner in which the cooling, air is brought into contact with the fruit in the lug. These methods are described in detail in U.S. Pat. No. 5,415,293, assigned to Rehrig Pacific Co., Inc., the entire contents of which are hereby incorporated by reference. Of these cooling methods, forced air cooling is generally preferred. This method delivers air directly to the fruit by establishing a pressure gradient across the lugs or crates that are disposed on a pallet. As a result, when the fruit itself is brought into close contact with the air, the cooling time is drastically reduced.

There are also generally three different types of containers which have been used in the prior art to package and ship table grapes. These containers are made from either wood, corrugated cardboard or polystyrene. The primary shipping container now in use is called a TKV container which is made of wooden ends and a combination of paper and thin wood for the long side walls and bottom. The wooden TKV container is a popular package because it can be stacked in a configuration three pallets high. The TKV package is also popular because it can successfully be utilized in a cold storage facility for an extended period of time.

Prior alternatives to the wooden TKV box are wax impregnated corrugated cardboard and foam polystyrene. The corrugated cardboard box is a short term shipping container which is used in applications where the grapes are usually picked and shipped within a period of one week. However, corrugated cardboard has a tendency to absorb moisture and fall apart. In addition, corrugated cardboard cannot be stacked in a configuration three pallets high because of limitations on the strength of the corrugated cardboard. Similarly, the foam polystyrene box does not stack three pallets high and has recycling limitations. As discussed in U.S. Pat. No. 5,415,293, the specific construction of the container used to ship grapes is important to successful fruit harvesting, cooling, storage and shipping. Moreover, when using the preferred forced air cooling process, the design of the container used to hold the grapes is critical. Air that bypasses the fruit pack has little cooling effect and therefore does little to reduce the length of the required cooling period. In addition, even relatively small openings around the packages can increase significantly the fan capacity required to maintain a given static pressure difference.

For example, prior art TKV containers have been used to store grapes temporarily during the forced air cooling process. However, when TKV containers are used, spacers or cleats are inserted between juxtaposed containers which are stacked on top of one another. Also, there are cleats on the lids, necessary for attachment. With this arrangement, a substantial amount of the cooling air flow is lost between the stacked TKV containers. Because the cooling air flow directed at the containers will follow the path of least resistance, a large quantity of cooling air naturally flows between the containers into the open areas created by the spacers or cleats. Accordingly, because a large quantity of air is lost, the volume of cooling air required to maintain a given static pressure difference is significantly increased. In turn, the large increase in required air volume necessitates a great increase in fan capacity to cool a give quantity of fruit, and thus, since more power is needed the cost is greater.

In addition, with the increasing concern for recycling as well as the rising price of wood, there is a need for a reusable plastic shipping container for table grapes that may even be manufactured with recycled material. A common method of achieving a high strength plastic container is to utilize a double wall construction around the entire periphery of the upper container rim. This construction, however, widely spaces adjacent containers such that the cooling air flow will take the path of least resistance between the containers rather than contacting the grapes within the containers. The grape container disclosed in U.S. Pat. No. 5,415,293 (the '293 patent) creates a compromise between the desirable strength characteristics afforded by the double wall construction and the undesirable effect of an air gap between abutting containers. This container design uses a double wall to single wall construction to form a crate having minimal space between adjacent crates and which is nestable when empty. The container may also be column stacked on pallets when the container lid is fitted into the recessed acceptance areas around the rim of the container. This arrangement ensures that the lid and upper rim present a flat surface when intermitted so that an adjacent container will lie flush against the rim and lid when placed on a pallet. The drawback, however, is that the '293 patent requires a two-part device, i.e. the container and the lid, in order to satisfy both the stacking and nesting requirements of a perishable goods container. The container lids must be removed in order to nest the empty containers within one another and return them to the field, thereby increasing the likelihood of the lids becoming lost or damaged during transport. In addition, the container lid must be physically removed in order to inspect the contents of the containers.

There is thus a need for a stackable and nestable one-part (container which is suitable for storing perishable food items and which minimizes the detrimental air flow loss when the container is subjected to a forced air cooling process.

SUMMARY OF THE INVENTION

The container of the present invention overcomes the disadvantages of the prior art two-part container, while still maintaining the necessary features for a successful forced air cooling process. The present invention provides a stackable and nestable container having a bottom surface, a first pair of opposed end walls integrally joined with the bottom surface and extending upwardly away therefrom, and a second pair of opposed side walls integrally joined with the bottom surface and extending upwardly away therefrom. The first and second pairs of opposed end walls and side walls are integrally joined with each other along common end surfaces thereof to form, along with the bottom surface a substantially rectangular open top container. The uppermost surfaces of the first and second pair of opposed end walls and side walls collectively form an upper container rim having a periphery. Each of the end walls and side walls includes a pair of column sections, with each column section including a recessed portion, an inner shelf and a lower column support. The recessed portions extend downwardly away from the container rim and terminate in the inner shelf, the inner shelf being disposed a predetermined distance above the bottom surface of the container. Each of the end walls and side walls further include a pair of stacking sections, with each stacking section including a stacking foot and a stacking shelf. The stacking foot is spaced inwardly from the container rim and extends downwardly so as to terminate in the stacking shelf disposed between the stacking foot and the container rim.

This novel construction provides a one-part stackable and nestable container that is adapted to be nestable with a similarly shaped container when the containers are disposed in a first orientation, and that is adapted to be stackable with a similarly shaped container when the containers are disposed in a second orientation, thus overcoming the need for a two-part container. The recessed portions of the column sections are adapted to receive the similarly shaped container such that the similarly shaped container rests upon the corresponding inner shelves of the stackable and nestable container where the containers are disposed in the first orientation. The stacking feet of the stacking sections are adapted to receive the lower column supports of the similarly shaped container such that the similarly shaped container rests upon the corresponding stacking shelves of the stackable and nestable container when the containers are disposed in the second orientation. In a preferred embodiment of the present invention, the first orientation and the second orientation of the container are offset by an one hundred eighty degree rotation about a vertical axis of the container.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF THE PREFERRED EMBODIMENTS

Figure 1:
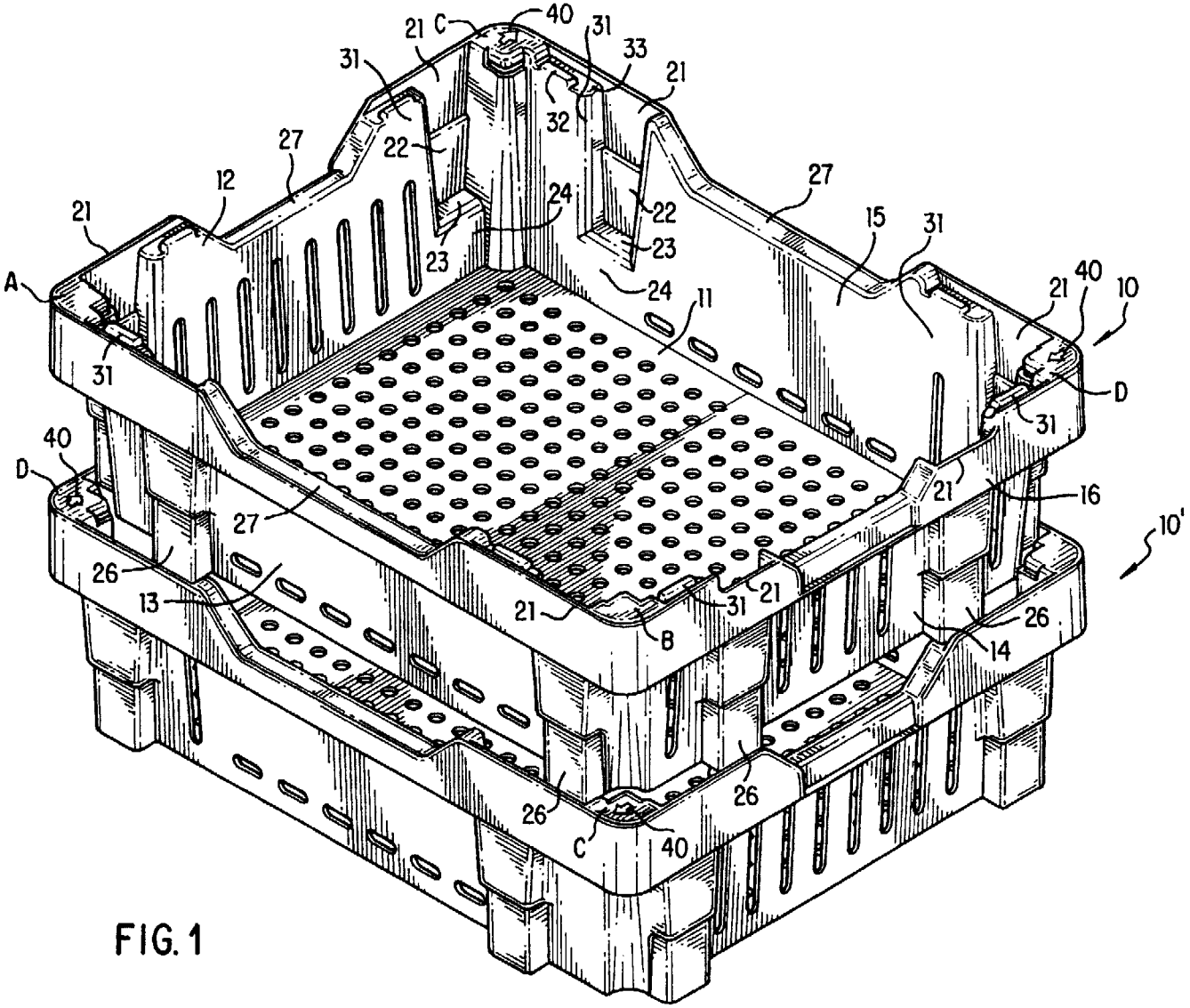
FIG. 1 is a top perspective view of two stackable and nestable containers according to the present invention being shown in a stacked orientation.
Figure 2:
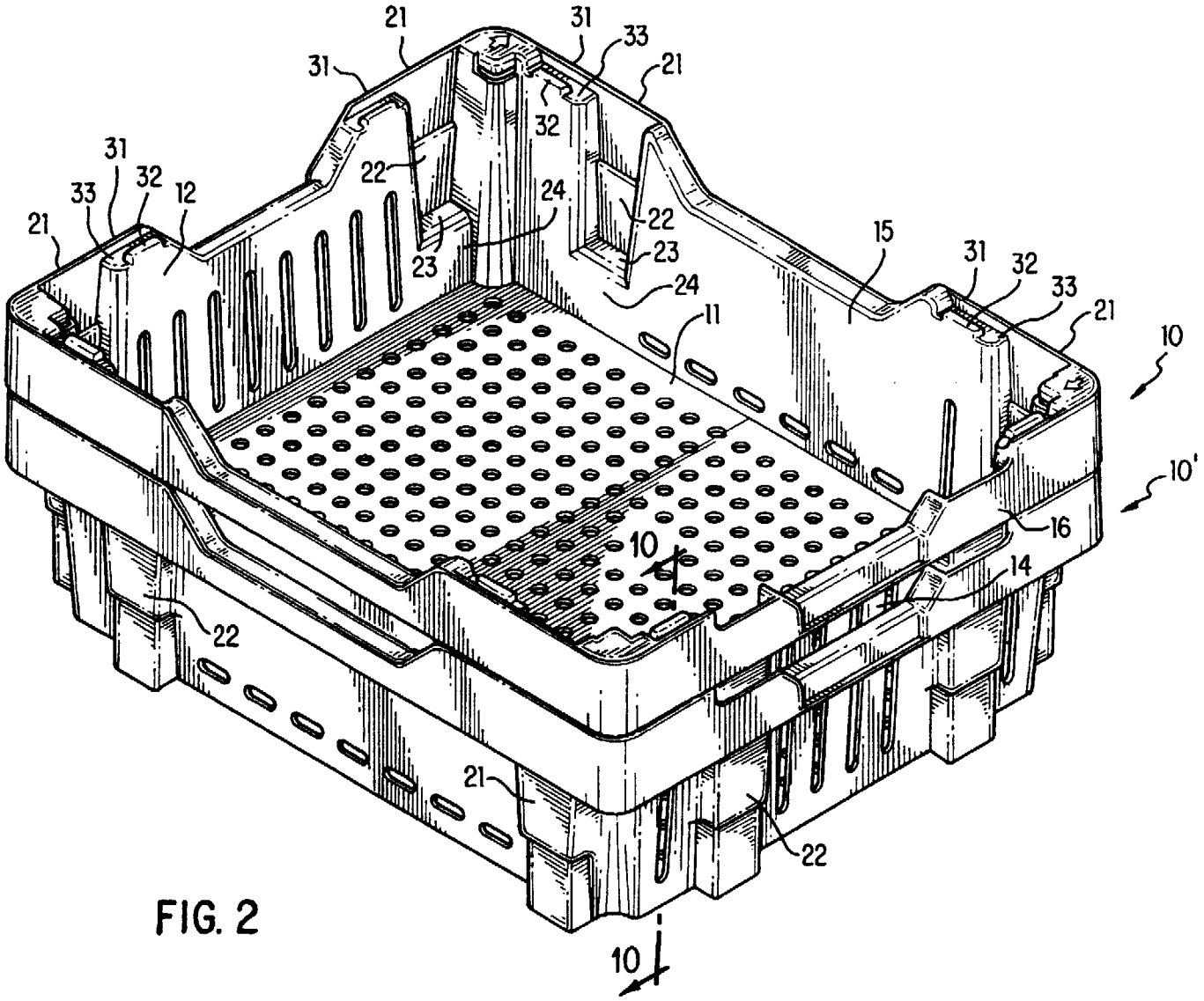
FIG. 2 is a top perspective view of two stackable and nestable containers according to the present invention being shown in a nested orientation.

Referring to FIGS. 1 and 2, containers of the present invention are shown generally by the reference number 10, 10'. The container 10, 10' is suitable for storage of any food item, but it is particularly suitable for the storage of perishable food items requiring the circulation of cooled air flow, such as grapes. Containers 10, 10' are substantially similar in construction, with a distinction being made only between an upper container 10 and a lower container 10', thus the following discussion of the construction of container 10 applies also to container 10'.

Container 10 comprises a bottom surface 11, a first pair of end walls 12, 14, and a second pair of side walls 13, 15. The pairs of opposed end walls and side walls 12, 14, 13, 15 are integrally joined with the bottom surface 11 and extend upwardly therefrom. The pairs of opposed end walls and side walls are also integrally joined with each other along common end surfaces. Thus, the end walls, side walls and bottom surface 11 together form a substantially rectangular top container 10. In a preferred embodiment, the bottom surface is apertured to allow for air circulation between containers when stacked.

The uppermost surfaces of the end walls and side walls (12, 13, 14, 15) collectively form an upper container rim 16. Each end wall and side wall further includes a dropped wall section 27 along a central portion thereof. The dropped wall section 27 includes a portion of the end walls and side walls where the upper container rim 16 is recessed a predetermined distance from its upper surface downwardly towards the container bottom surface 11. The dropped wall section 27 assists in giving the container a full appearance after the perishable food items therein have settled, and as explained more fully below, aid in the circulation of a cooled air flow.

Figure 3:
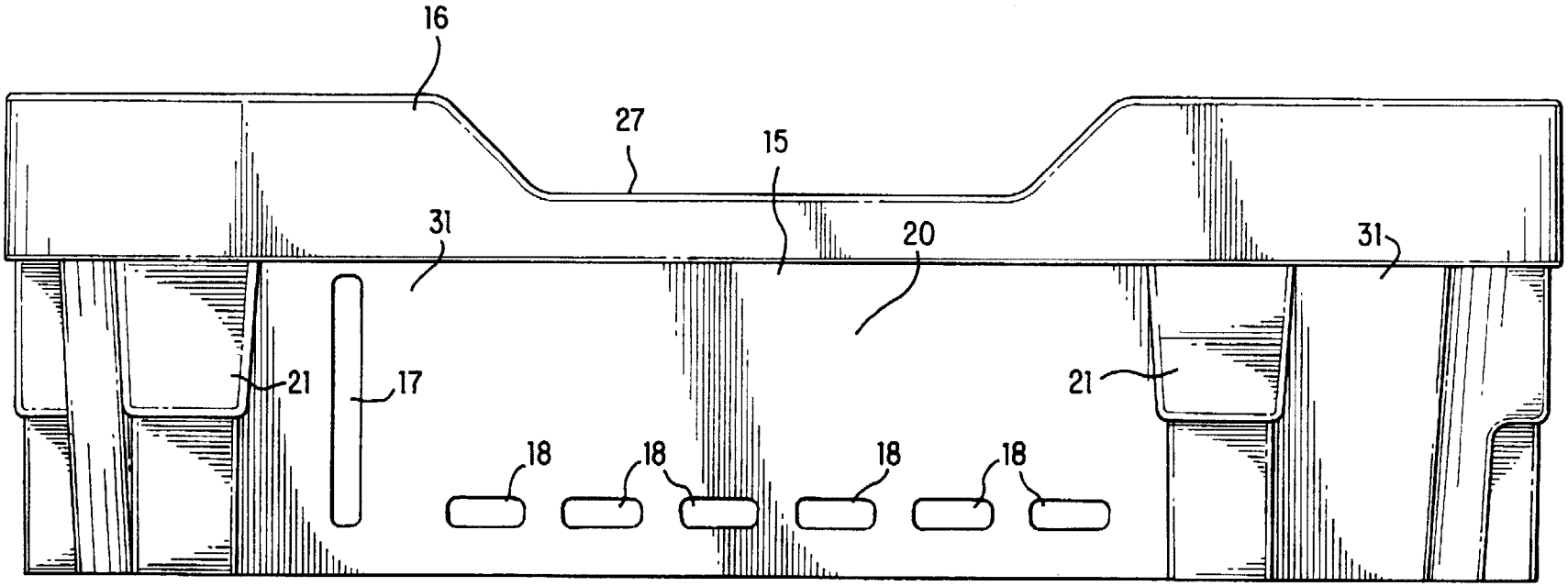
FIG. 3 is a left side elevational view of the uppermost (container shown in FIG. 1.
Figure 4:
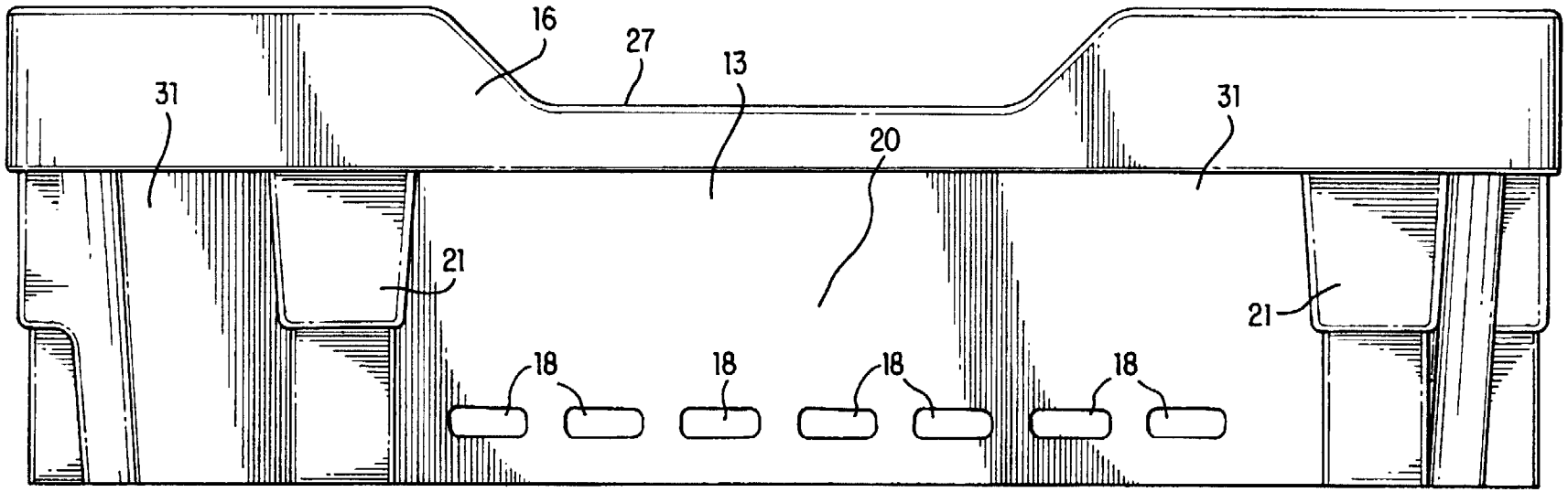
FIG. 4 is a right side elevational view thereof.
Figure 5:
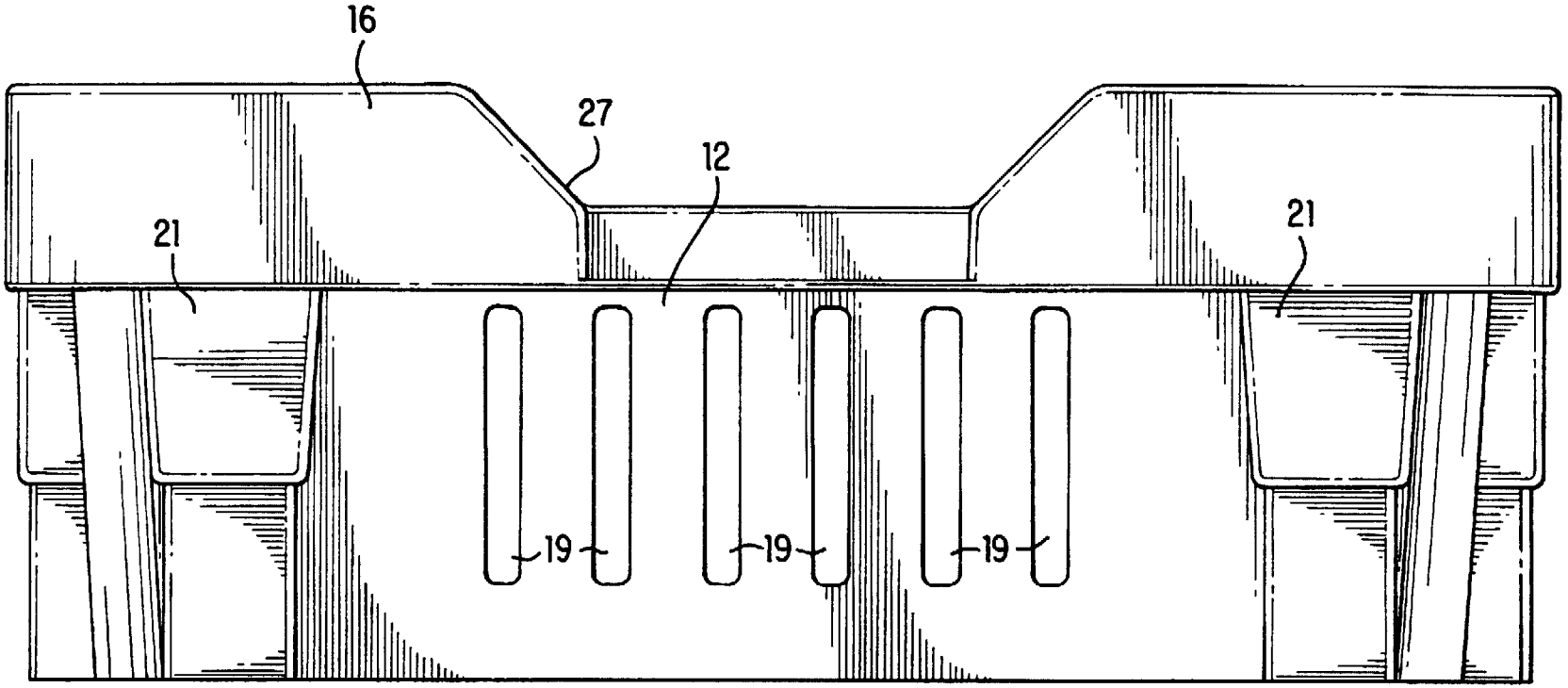
FIG. 5 is a rear view thereof.
Figure 6:
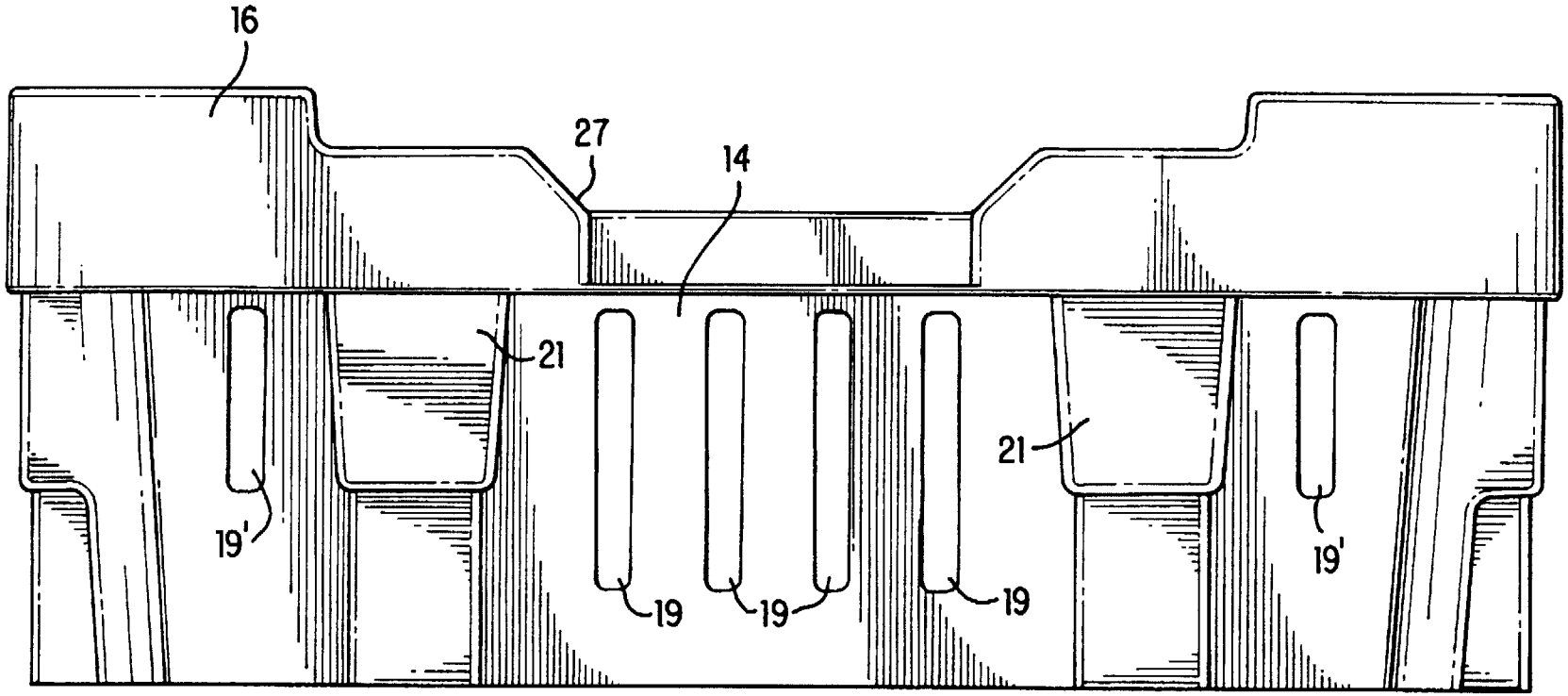
FIG. 6 is a front view thereof.
Figure 7:
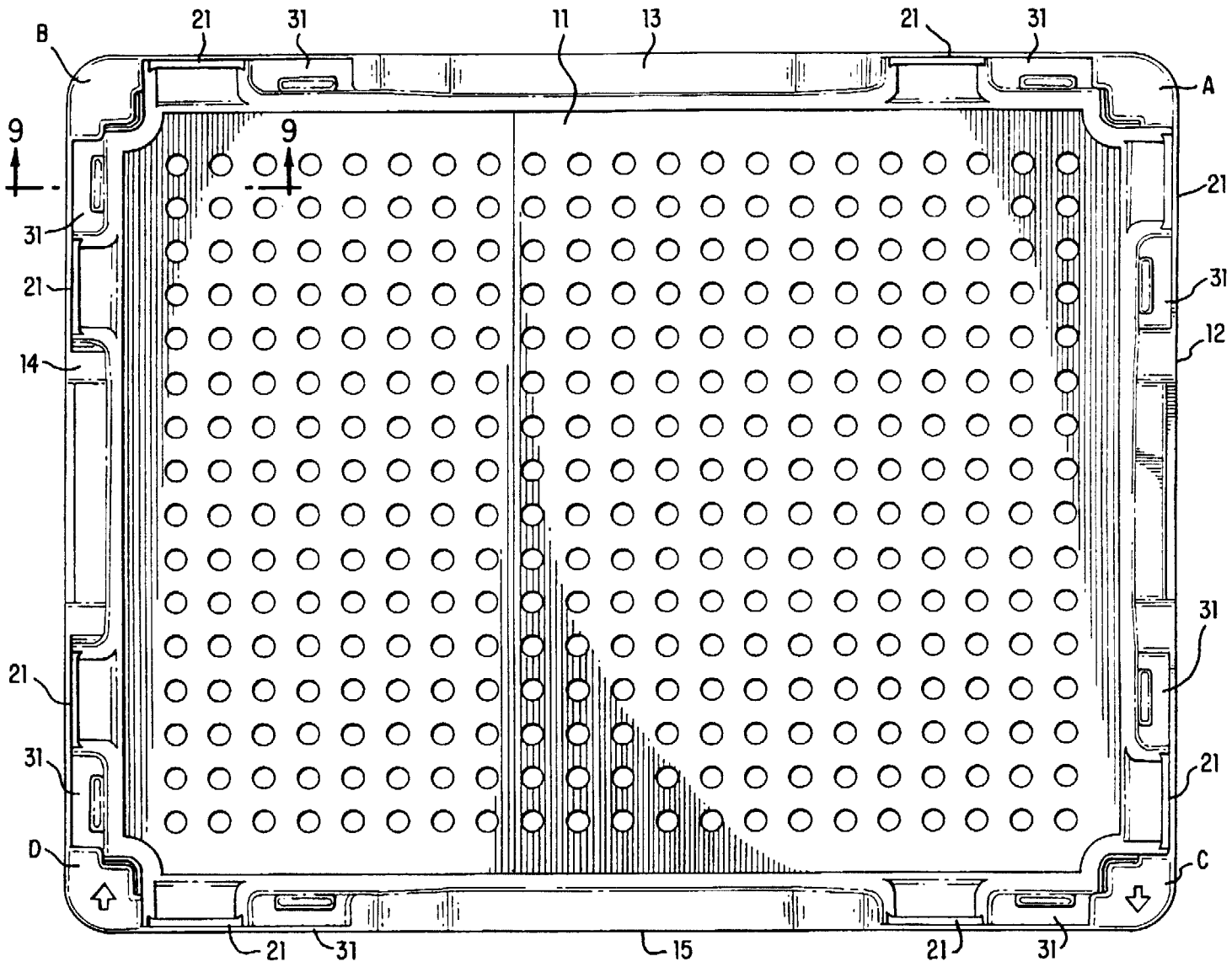
FIG. 7 is a top plan view thereof.
Figure 8:
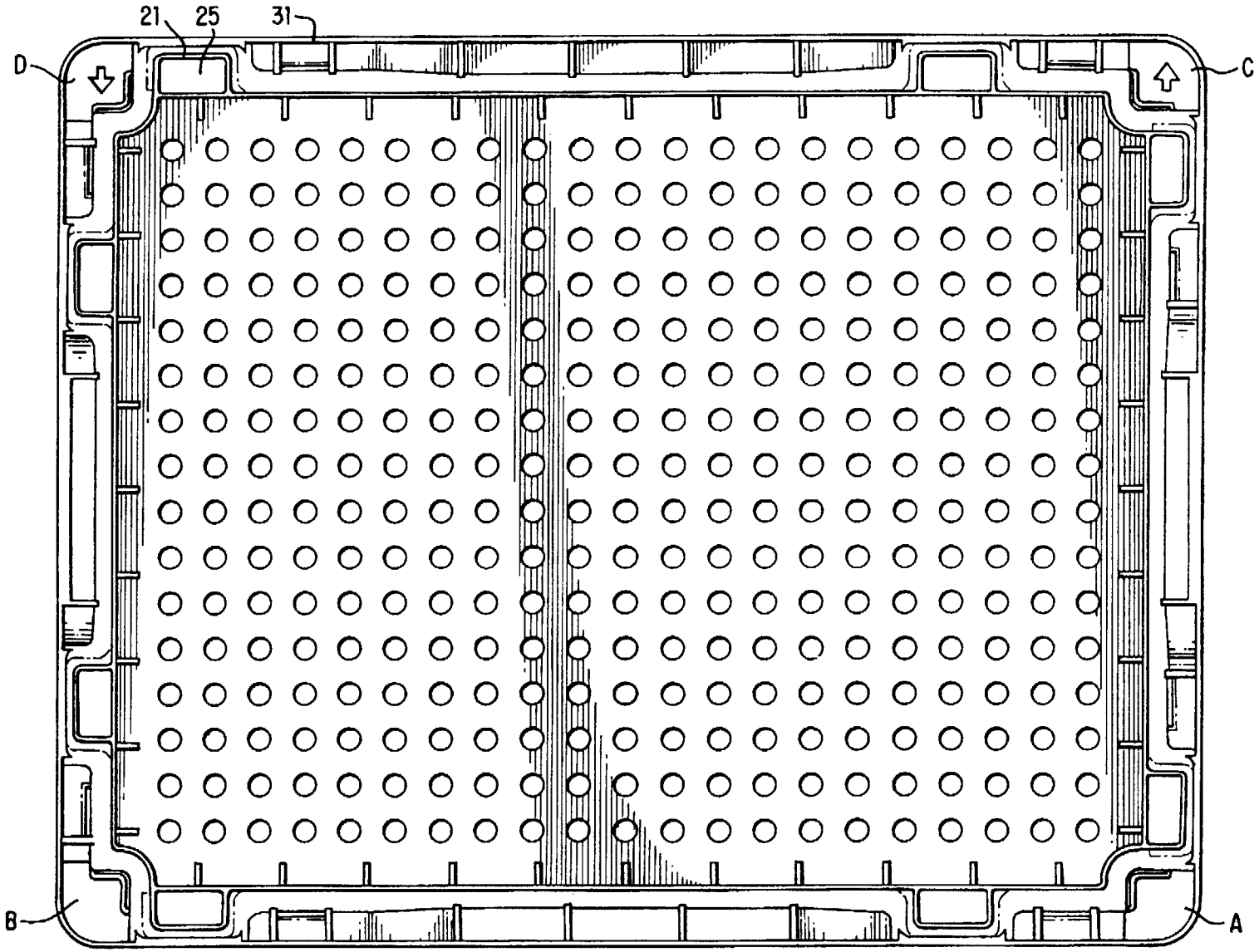
FIG. 8 is a bottom plan view thereof.

The side walls 13, 15 each include a plurality of ventilation apertures formed in a central portion thereof below the dropped wall section 27, as shown in FIGS. 3 and 4. Side walls 13, 15 each include ventilation apertures 18 that are generally transverse apertures aligned side by side in a transverse row. As shown, the construction of side walls 13, 15 is not identical, as discussed more fully below, thus, in addition to apertures 18, side wall 15 also includes a vertically extending aperture 17. Similarly, as illustrated in FIGS. 5 and 6, each of the end walls 12, 14 also includes ventilation apertures 19 disposed below the respective dropped wall section 27. Ventilation apertures 19 are generally vertically extending apertures aligned side by side in a transverse row. The construction of end walls 12, 14 is not identical, as discussed more fully below, and that the placement of ventilation apertures 19 is thus not identical. In addition, end wall 14 includes additional apertures 19' extending vertically for a shorter distance adjacent each edge of the end wall. Each of the side walls 13, 15 may also include a substantially flat open surface area 20 which may be used to display a label.

Figure 9:
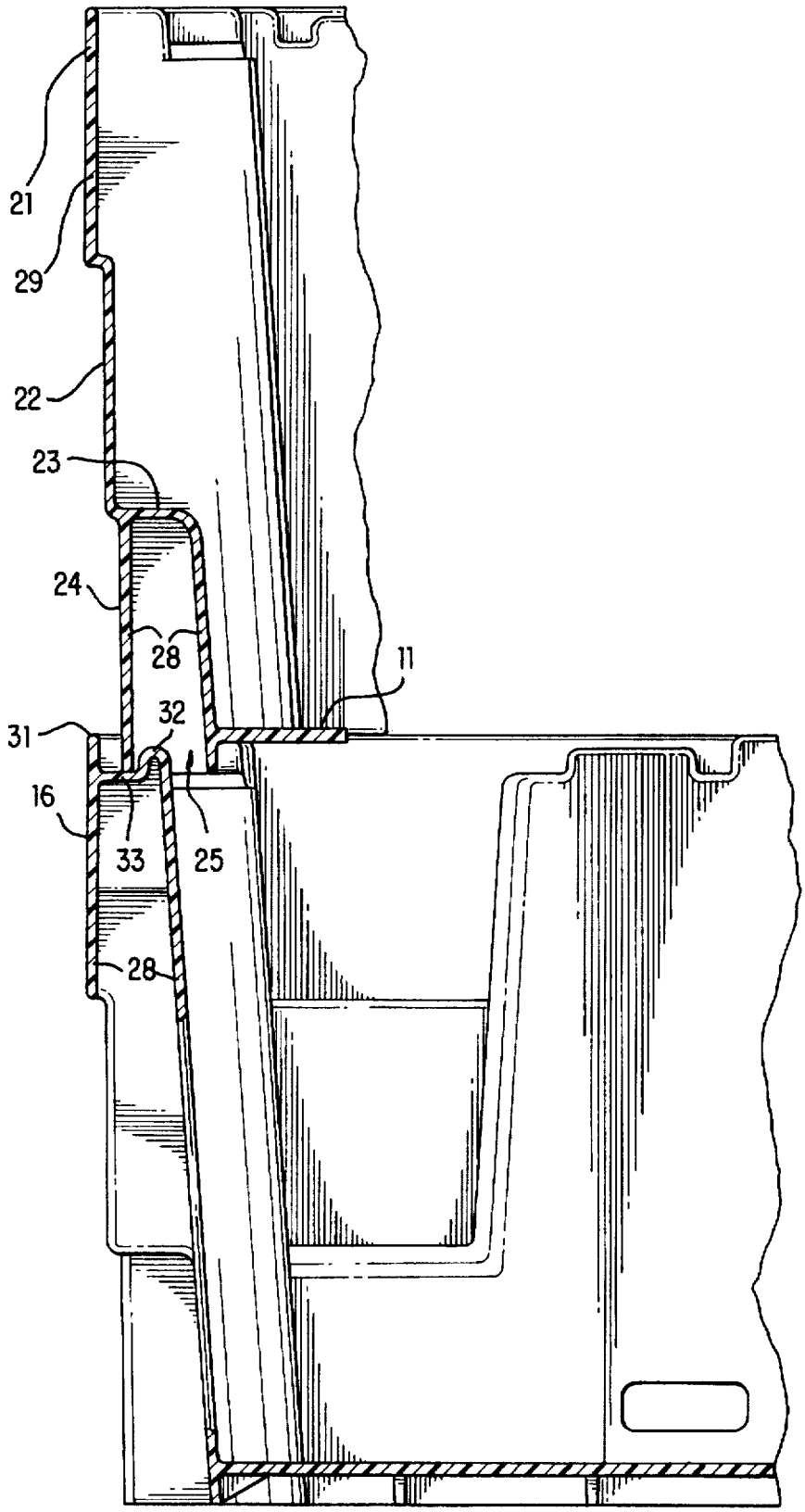
FIG. 9 is a partial cross-sectional view taken general y along the line 9—9 of FIG. 1.

Each of the end walls and side walls 12, 13, 14, 15 includes a pair of column sections 21 disposed near the corners of the rectangular container 10, 10', and a pair of stacking sections 31 disposed adjacent thereto. As best shown in FIGS. 1 and 9, each column section 21 includes a recessed portion 22, an inner nesting shelf 23, and a lower column support 24. Each stacking section 31 includes a stacking foot 32 and a stacking shelf 33. As shown in the drawings, the positioning of each column section 21 and each stacking section 31 is different for each end wall 12, 14 and each side wall 13, 15. This unique asymmetric construction allows container 10 to be stacked with an identical lower container 10', as shown in FIG. 1, and with a mere rotation about one hundred eighty degrees, nested with an identical lower container 10', as shown in FIG. 2.

The recessed portion 22 of each column section 21 extends downwardly away from the upper container rim 16 and terminates in an inner shelf 23. The inner shelf is disposed a predetermined distance above the bottom surface 11 of the container 10. The column sections 21 further include a lower column support 24. This lower column support 24 is made up of a double wall 28 of container material. The lower column support 24 is disposed below the recessed portion 22 in the column section 21 and adjacent the bottom surface 11 of the container. The inner shelf 23 forms the uppermost surface of the lower column support 24, while the lowermost surface of each lower columns support 24 is a receiving opening 25 defined by the double wall 28 construction thereof. Column sections 21 also form outer surfaces 26 which project outwardly away from the end walls and side walls.

Figure 10:
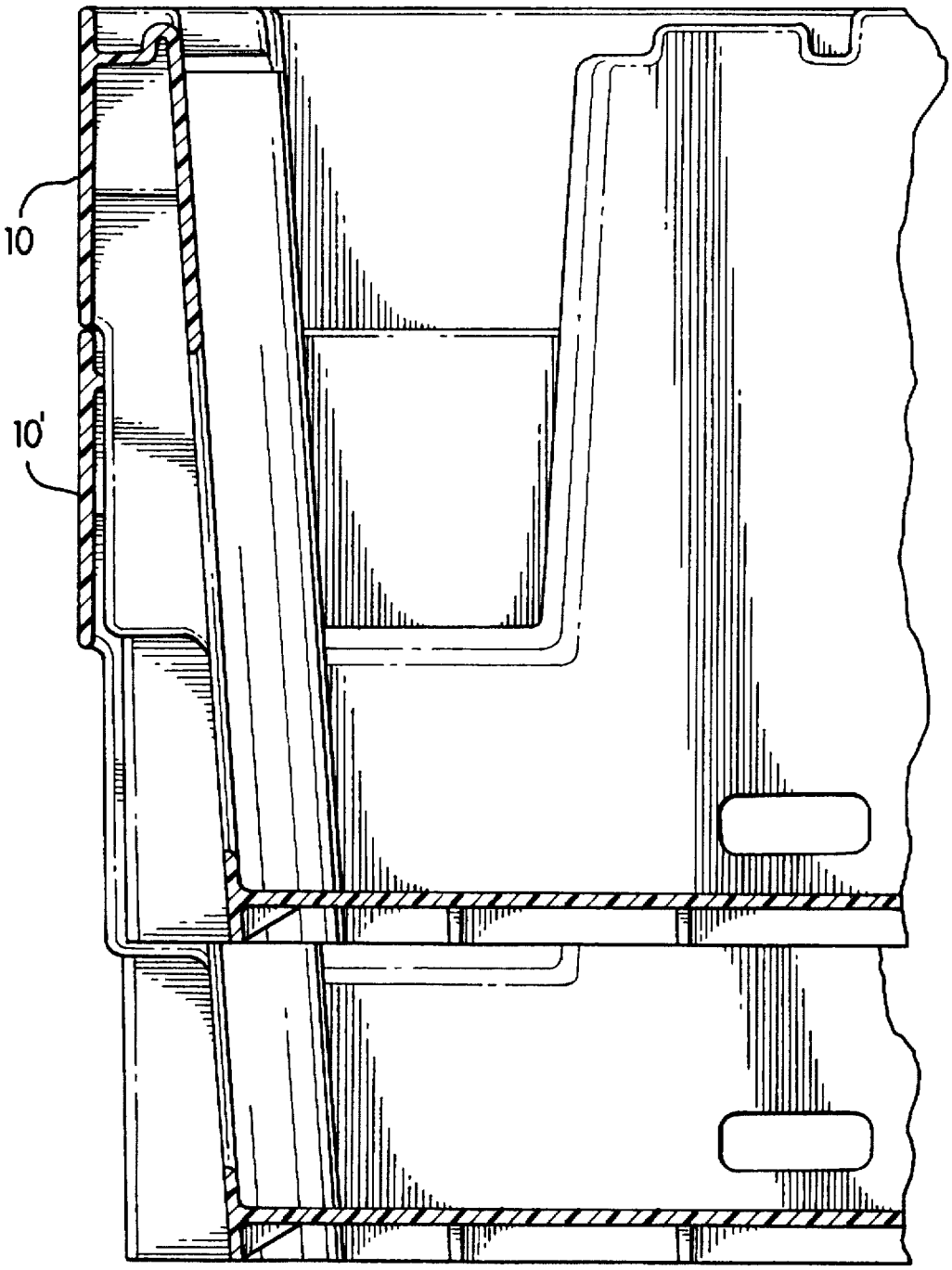
FIG. 10 is a partial cross-sectional view taken generally along the line 10—10 of FIG. 2.

The upper container rim 16 has a double thickness of material 28 around substantially its entire periphery. The remainder of the periphery of the upper container rim 16 has only a single thickness of material 29. As best shown in FIGS. 9 and 10, the upper container rim 16 has a single thickness 29 only along those surfaces located adjacent to the recessed portions 22 of the column sections 21.

This double to single thickness constructions serves several important functions. First, the double wall construction 28 around substantially the entire periphery of the upper container rim 16 provides sufficient strength to the container for stacking. Second, the single thickness construction 29 in the areas of the column sections 21 allows the container to easily assume a nesting configuration with a similarly shaped container. Third, the double thickness constructions 28 of the lower column support 24 maintains the overall high strength of the container in the potentially weak single thickness areas 29 formed by the recessed portions 22 of the column sections 21. Fourth, the double to single thickness construction provides a column section 21 with an outer surface 26 that projects outwardly away from the side and end walls such that the container will closely abut with a similarly shaped container. Finally, the double thickness construction of the lower columns support 24 provides the container with a smooth lower internal surface that will not damage perishable food items that come into contact therewith. These features and the advantages provided therefrom are discussed more fully in U.S. Pat. No. 5,415,293.

As shown in FIGS. 2 and 10, the recessed portions 22 of the column section 21 are adapted to receive corresponding portion of a similarly shaped container when the containers are placed in a nested configuration. The outer surfaces 26 of the column sections 21 of upper container 10 are received within the corresponding recessed portions 22 in the column sections 21 of the lower container 10' when the containers are positioned in a first orientation for nesting. When nested, upper container 10 rests upon the corresponding inner shelves 23 of lower container 10'.

As shown in FIGS. 1 and 9, the stacking foot 32 of each stacking section 31 is disposed along the inner edge of each end wall and side wall, spaced inward from upper container rim 16 so as to form a stacking shelf 33. Stacking feet 32 are adapted to be received within openings 25 on the lowermost surface of column supports 24 of a similarly shaped upper container when the containers are placed in a stacked configuration. The opening 25 defined by outer surfaces 26 of the column sections 21 of an upper container 10 receive therewithin the corresponding stacking feet 32 of a lower container 10' when the container are positioned in a second orientation for stacking. When stacked, the upper container 10 rests upon the corresponding stacking shelves 33 of the lower container 10'.

In order to achieve both nesting and stacking, depending upon the orientation of an upper container relative to a lower container, container 10 has a unique asymmetric construction. More specifically, end wall 12 includes a pair of column sections 21 and a pair of stacking sections 31 symmetrically arranged about dropped wall section 27, with the stacking sections 31 being disposed adjacent dropped wall section 27 and column sections 21 disposed adjacent thereto. Thus, each column section 21 is disposed between the corner of the container and a stacking section 31. On the other hand, end wall 14 includes a pair of column sections 21 symmetrically arranged about dropped wall section 27 and stacking sections 31 are disposed adjacent thereto. Thus, each stacking section 31 is disposed between the corner of the container and a column section 21.

Further, side wall 13 includes a column section 21 adjacent dropped wall section 27 on a first side thereof, and a stacking section 31 adjacent the second side of dropped wall section 27. Thus, on the first side of dropped walls section 27, a stacking section 31 is disposed between the corner of the container and the column section 21, and on the second side of dropped wall section 27, a column section 21 is disposed between the corner of the container and the stacking section 31. Moreover, the first side of dropped wall section 27 of side wall 13 adjoins end wall 12 such that corner A of the container is adjacent to column section 21 of end wall 12 and stacking section 31 of side wall 13. Similarly, the second side of dropped wall section 27 of side wall 13 adjoins end wall 14 such that corner B of the container is adjacent to stacking section 31 of end wall 14 and column section 21 of side wall 13.

Similarly, side wall 15 includes a column section 21 adjacent a first side of dropped wall section 27 and a stacking section 31 adjacent a second side thereof. Thus, on the first side of dropped walls section 27, a stacking section 31 is disposed between the corner of the container and the column section 21, and on the second side of dropped wall section 27, a column section 21 is disposed between the corner of the container and the stacking section 31. Moreover, the first side of dropped wall section 27 of side wall 15 adjoins end wall 12 such that corner C of the container is adjacent to column section 21 of end wall 12 and stacking section 31 of side wall 15. Similarly, the second side of dropped wall section 27 of side wall 15 adjoins end wall 14 such that corner D of the container is adjacent to stacking section 31 of end wall 14 and column section 21 of side wall 15.

Thus, as shown in FIG. 1, when comer A of upper container 10 is positioned on top of corner D of lower container 10' in a first orientation, a stacked arrangement is obtained. When container 10 is rotated by one hundred eighty degrees such that corner A of upper container 10 is positioned on top of a corresponding corner A of lower container 10' in a second orientation, the nested arrangement of FIG. 2 is obtained. Arrows 40 may be provided, such as shown on corners C and D of each container, in order to assist in determining the orientation of the containers.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

We claim:

1. A stackable and nestable container comprising a bottom surface, a first pair of opposed side walls integrally joined with said bottom surface and extending upwardly away therefrom, a second pair of opposed side walls integrally joined with said bottom surface and extending upwardly away therefrom, said first and second pairs of opposed side walls being integrally joined with each other along common end surfaces thereof to form with said bottom surface a substantially rectangular open top container, the uppermost surfaces of said first and second pair of opposed side walls collectively forming an upper container rim having a periphery;

at least one of said pairs of side walls including a pair of column sections, each said column section including a recessed portion, an inner shelf and a lower column support, said recessed portions extending downwardly away from said container rim and terminating in said inner shelf, said inner shelf being disposed a predetermined distance above said bottom surface of said container;

at least one of said pairs of side walls further including a pair of stacking sections, each said stacking section including a stacking foot and a stacking shelf, said stacking foot being spaced inwardly from said container rim and extending downwardly so as to terminate in said stacking shelf disposed between said stacking foot and said container rim;

wherein said stackable and nestable container is adapted to be nestable with a similarly shaped container when said containers are disposed in a first orientation; and wherein said stackable and nestable container is adapted to be stackable with a similarly shaped container when said containers are disposed in a second orientation.

2. The stackable and nestable container of claim 1 wherein said recessed portions of said column sections are adapted to receive said similarly shaped container such that said similarly shaped container rests upon the corresponding inner shelves of said stackable and nestable container when said containers are disposed in said first orientation.

3. The stackable and nestable container of claim 1 wherein said stacking feet of said stacking sections are adapted to receive said lower column support of said similarly shaped container such that similarly shaped container rests upon the corresponding stacking shelves of said stackable and nestable container when said containers are disposed in said second orientation.

4. The stackable and nestable container of claim 3 wherein the lowermost surface of each said lower column support comprises an aperture, and wherein said lower column support apertures of said similarly shaped container are adapted to receive said stacking feet of said container when said container and said similarly shaped container are disposed in said second orientation.

5. The stackable and nestable container of claim 1 wherein said first orientation and said second orientation are offset by an one hundred eighty degree rotation about a vertical axis of said container.

6. The stackable and nestable container of claim 1 wherein said lower column supports and said stacking sections form a smooth internal surface for said container such that perishable food items placed within said container are not damaged when forced into contact with said lower column supports and said stacking sections.

7. The stackable and nestable container of claim 1 wherein said first pair of opposed end walls include a first end wall and a second end wall, said first and second end walls being asymmetric.

8. The stackable and nestable container of claim 7 wherein said first end wall includes one of said column sections at each edge thereof and one of said stacking sections disposed inwardly from each said column section, and said second end wall includes one of said stacking sections at each edge thereof and one of said columns sections disposed inwardly from each said stacking section.

9. The stackable and nestable container of claim 7 wherein said second pair of opposed side walls include a first side wall and a second side wall, said first and second side walls being asymmetric.

10. The stackable and nestable container of claim 9 wherein each of said first and second side walls include one of said stacking sections at each edge thereof and one of said column sections disposed inwardly from each said stacking section.

11. The stackable and nestable container of claim 1 wherein said end walls and said side walls integrally join to form four corners of said substantially rectangular container, each said corner being immediately adjacent to one of said column sections on one side thereof and one of said stacking sections on another side thereof.

12. A stackable and nestable open top container comprising:

a bottom surface;

a first pair of opposed side walls integrally joined with said bottom surface and extending upwardly away therefrom;

a second pair of opposed side walls integrally joined with said bottom surface and extending upwardly away therefrom, said first and second pairs of opposed end walls and side walls being integrally joined with each other along common end surfaces thereof to form with said bottom surface a substantially rectangular open top container;

at least two of said side walls including a pair of stacking sections each comprising a stacking foot and a stacking shelf, said stacking foot being spaced inwardly from said container rim and extending downwardly so as to terminate in said stacking shelf disposed between said stacking foot and said container rim, said stacking sections adapted to support a similarly shaped container stacked thereon;

wherein at least two of said side walls include a lower column support having a double thickness of material;

wherein said stackable and nestable container is adapted to be nestable with a similarly shaped container when said containers are disposed in a first orientation; and wherein said stackable and nestable container is adapted to b stackable with a similarly shaped container when said containers are disposed in a second orientation, said first and said second orientations being offset by an one hundred eighty degree rotation about a vertical axis of said container.

13. The stackable and nestable container of claim 12 wherein each of said side walls includes at least one column section and at least one stacking section.

14. The stackable and nestable container of claim 13 wherein each said column section includes a recessed portion, an inner shelf and a lower column support.

15. The stackable and nestable container of claim 14 wherein said recessed portion extends downwardly away from an uppermost surface of said container and terminates in said inner shelf, said inner shelf being disposed a predetermined distance above said bottom surface of said container.

16. The stackable and nestable container of claim 13 wherein each said stacking section includes a stacking foot and a stacking shelf.

17. The stackable and nestable container of claim 16 wherein said stacking foot is disposed inwardly from an outermost surface of said container and extends downwardly to terminate in said stacking shelf, said stacking shelf being defined between said stacking foot and the outermost surface of said container.

* * * * *